United States Patent [19]

Bonkowski

[11] Patent Number: 4,901,991

[45] Date of Patent: Feb. 20, 1990

[54] WORKPIECE CLAMPING DEVICE

[76] Inventor: Ritchie G. Bonkowski, 160 S. "A" St., Tustin, Calif. 92680

[21] Appl. No.: 141,327

[22] Filed: Jan. 6, 1988

[51] Int. Cl.[4] ..... B25B 5/04

[52] U.S. Cl. ..... 269/234

[58] Field of Search ..... 269/233, 234

[56] References Cited

U.S. PATENT DOCUMENTS

| | | | |
|---|---|---|---|
| 128,260 | 6/1872 | Taylor . | |
| 291,282 | 1/1884 | Blue . | |
| 2,348,819 | 5/1944 | Johnson | 279/2 |
| 2,463,292 | 3/1949 | McCallion | 279/55 |
| 2,601,419 | 6/1952 | Spahn | 279/2 |
| 3,893,813 | 7/1975 | Johnson | 23/292 |
| 3,986,383 | 10/1976 | Petteys | 72/393 |
| 4,515,355 | 5/1985 | Hunter | 269/23 A |

FOREIGN PATENT DOCUMENTS

| | | | |
|---|---|---|---|
| 163854 | 12/1981 | Japan | 269/234 |

OTHER PUBLICATIONS

Pacific Industrial Supply Co., "AngLock", Sheets 4 through 18.

*Primary Examiner*—Gene Wan

*Attorney, Agent, or Firm*—Spensley Horn Jubas & Lubitz

[57] ABSTRACT

The limited working region of a numerically controlled machine can be filled to maximum capacity with multiple strips of workpiece stock by providing one or more workpiece holding units each of which has opposed vertical walls between which two or more strips of workpiece stock may be disposed. An expansion device is actuated between the walls to generate outwardly directed forces against the walls and the two or more workpieces. The expansion device has a wedge that is elastically pushed between a plurality of laterally movable jaw pieces to force the jaw pieces apart.

19 Claims, 7 Drawing Sheets

WORKPIECE CLAMPING DEVICE

BACKGROUND OF THE INVENTION

1. Field of the Invention

The present invention is directed generally to a device for clamping a workpiece to a tooling fixture.

2. Description of the Prior Art

The introduction of robotics and computerized numerical control (CNC) machines into the traditional machine shop allows for significant cost reduction in the manufacture of machined items. The time consuming and tedious tasks of controllably moving a cutting tool to shape the three dimensional contours of to-be-produced articles can be transferred from a skilled machinist to a suitably programmed computer. A block of raw stock (usually an elongated block of metal having a rectangular cross section ) is firmly secured into a fixture in the working region of a CNC milling machine. The CNC machine is turned on and a set of pre-programmed machining instructions are supplied to the CNC servomechanism. The machinist is then free to attend to other tasks while the CNC machine proceeds to cut the stock in accordance with the programmed machining instructions. The machinist need not return to the CNC machine until the programmed machining operations are completed. The cost of labor can be reduced by enabling the machinist to attend to more than one such machining operation at a time.

While certain aspects of this type of machining technology have advanced substantially, the step of fixedly securing a workpiece to the workbed of a CNC machine still relies quite often on a conventional vise such as the vise 5 shown in FIG. 1. The vise 5 is formed of a movable jaw 10 having an L-shaped configuration, a fixed jaw 12 of a complementary L-shaped configuration, and an adjusting screw 14 threaded through at least one of the jaws. The adjusting screw 14 can be torqued to create an inwardly directed force $F_I$ between the movable jaw 10 and the fixed jaw 12. The L-shaped jaws may have serrations at their respective ends as shown in FIG. 1. The inwardly directed force $F_I$ may be transmitted through the serrated ends to secure a workpiece 16 as shown. .

Since the vise 5 can be used for a multitude of different kinds of workpiece securing operations, its efficiency is rarely questioned in the specific context of CNC machining. One often ignored problem concerns the magnitude of the securing force $F_I$. The securing force $F_I$ should be sufficiently strong to prevent the workpiece 16 from slipping out of position when a rotating cutting tool 18 belonging to a CNC machine 20 engages against the workpiece. If the machinist fails to tighten the adjusting screw 14 sufficiently, vibrations from the cutting tool 18 may loosen the adjusting screw 14 and thereby allow the workpiece 16 to slip out of position. Subsequent machining operations, that are often performed blindly by the servomechanism of the CNC machine 20, can then fall out of tolerance.

Another problem not normally recognized with respect to the vise 5 in the context of CNC machining, involves the shape and size of the vise 5. The conventional vise 5 is relatively bulky. Provisions are usually made for allowing the movable jaw 10 to travel over considerable distances so that differently sized workpieces can be accomodated. The vise 5 consumes a substantial amount of space because of its bulk and workpiece accomodating features.

In FIG. 1, the cutting tool 18 is shown to be held in a rotating spindle 20*a* of the CNC machine 20. The spindle 20*a* is limited in its movement, with respect to the workpiece 16, to operate in the confines of a predetermined working region $R_{xyz}=R_z$ by $R_x$ by $R_y$. The region $R_{xyz}$ is typically defined by the vertical movement limitations of the spindle 20*a* and the movement limitations of an x-y translation table (not shown) to which the vise 5 is mounted. The workpiece 16 is positioned to protrude beyond the vise jaws, 10 and 12, into the working region $R_{xyz}$ of the spindle 20*a* so that desired portions 16*a* of the workpiece can be accessed and removed by the cutting tool 18. It often occurs that the vise 5, rather than the workpiece 16, consumes a bulk of the limited working region $R_{xyz}$. It will be appreciated that this constitutes an inefficient use of the CNC working region $R_{xyz}$.

Under current practice, a plurality of machined items 16*b* are typically produced during one cycling of the CNC machine 20 by forming the original workpiece block 16 as an elongated strip (extending perpendicularly to the plane of FIG. 1). A series of individual items 16*b* are machined along the elongated strip 16. This strip processing practice helps to reduce manufacturing cost. When the number of individual items 16*b* that can be produced during a single cycling of the CNC machine 20 is increased the cost per cycle is decreased. Even with such strip processing, the cost per cycle is not fully minimized. The number of items that can be machined in one cycle is limited by the dimensions of the individual items, the dimensions, $R_x$, $R_y$ and $R_z$, of the working region $R_{xyz}$ and also by the space requirements of the vise 5. Because substantial forces often have to be transferred from the screw 14 to the workpiece 16 through the bends of the L-shaped jaws, 10 and 12, the jaws are usually made quite thick. This consumes space that could be otherwise filled with workpieces. Additional space is taken up by the length of the adjusting screw 14 and the travel area provided for the movable jaw 10. More space may be consumed when room has to be provided for accessing a head portion 14*a* of the adjusting screw 14 in order to tighten and loosen the screw. As such, the total space available in the working region R of the CNC machine is rarely utilized with optimum efficiency. This is particularly the case when each individual item 16*b* is much smaller than the total space available in the CNC working region $R_{xyz}$.

SUMMARY OF THE INVENTION

In accordance with a first aspect of the present invention, a pair of opposed fixture walls are disposed in facing relation to one another. A movable wedge, having an inclined portion, is disposed between the fixture walls with the inclined portion facing one of the walls. A movable jaw piece, having a wedge engaging end and an opposed workpiece engaging end, is positioned between the wedge and the one wall. A workpiece is interposed between the workpiece engaging end of the jaw piece and the one wall. The wedge engaging end of the jaw piece is adapted to slidably engage with the inclined portion of the wedge. The wedge is disposed to reciprocate in a first direction, generally parallel to the fixture walls, while the jaw piece is adapted to reciprocate in a second direction, generally perpendicular to the walls. An actuator means applies a continuous first force, in the first direction, to the wedge. The inclined portion of the wedge translates that first force into a second force directed in the second direction against the wedge engaging end of the movable jaw piece. The second force is transmitted through the jaw piece to the workpiece to thereby secure the workpiece between the movable jaw piece, the wedge, and the fixture walls.

The arrangement has a self-tightening feature. If a machining operation vibrates the wedge engaging end of the jaw piece away from the inclined portion of the wedge, the first force advances the wedge and causes it to re-engage with the jaw piece so that slack between the wedge, jaw piece, and workpiece will be substantially eliminated. The workpiece is inhibited from shaking loose of its position between the fixture walls. Workpiece dislocation is thereby inhibited.

In accordance with a second aspect of the present invention, a plurality of workpieces are secured between an expansion type force applying device and a plurality of fixed walls. The plurality of workpieces may be secured or released in unison from their positions between the expansion device and the respective fixed walls by a single actuation of the expansion device. Time required for securing/ releasing the plural workpieces is thereby minimized.

In accordance with a third aspect of the present invention, parallel strips of workpiece material are secured between a set of fixture walls and one or more expansion devices so that more than one strip of material can be machined within the limited working region of a CNC machine during a CNC machining cycle.

DETAILED DESCRIPTION

The description provided below is of the best presently contemplated modes for carrying out the invention. The modes are described for the purpose of explaining the principles of the invention and are not intended to be taken in a limiting sense. The scope of the present invention is better defined by reference to the accompanying claims.

Figure 2:
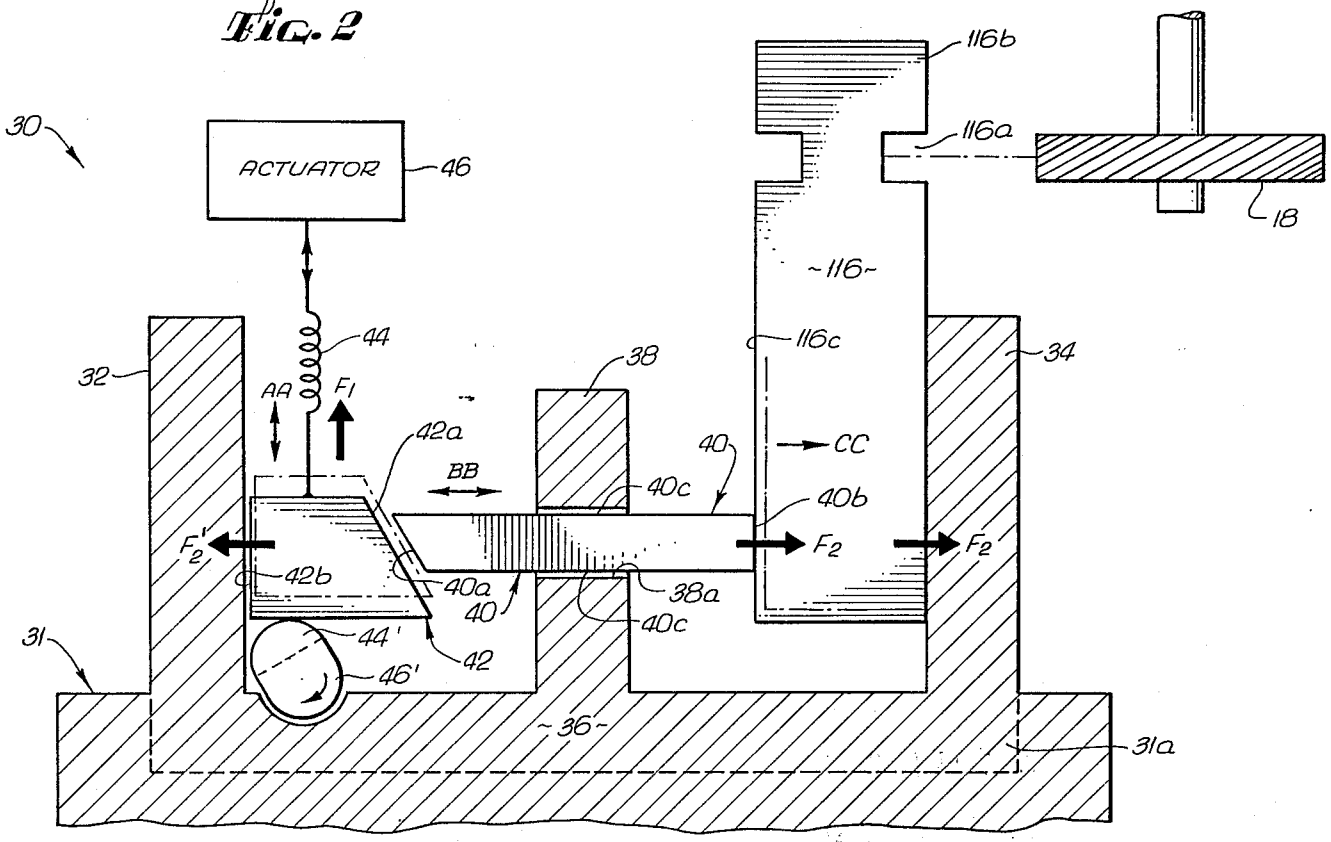
FIG. 2 is a sectional view of a first clamping device according to the invention.

FIG. 2 is a sectional view, presented partly in block diagram form, of a first embodiment 30 in accordance with the present invention. A generally W-shaped fixture 31 is provided with a pair of opposed fixture walls, 32 and 34, projecting vertically from a lateral base 36. Preferably, the fixture walls are integrally and fixedly connected to the lateral base with their facing interior sides rising perpendicularly from the lateral base. The base 36 and opposed fixture walls 32, 34 define a U-shaped force containing portion 31*a* of the fixture 31. A jaw guide 38 is attached to the base 36 between the walls, 32 and 34. A movable jaw piece 40 having a wedge engaging end 40*a* and opposed workpiece engaging end 40*b* is disposed to reciprocate laterally (direction BB) through a guide hole 38*a* provided in the jaw guide 38. The wedge engaging end 40*a* is preferably formed to include a planar inclined surface. The workpiece engaging end 40*b* of the jaw piece is disposed to engage a securable surface 116*c* of a workpiece 116. The jaw piece 40 is preferably made of a relatively nonelastic material such as a hardened steel. Although not visible in FIG. 2, the workpiece engaging end 40*b* is preferably roughened or serrated to firmly grip the securable surface 116*c*. The surfaces of the wedge engaging end 40*a* and a reciprocally guided portion 40*c* of the jaw piece 40 passing through the guide hole 38 are preferably finished smooth to minimize sliding friction.

A movable wedge 42 having an inclined portion 42*a* is disposed between a first of the fixture walls 32 and the wedge engaging end 40*a* of the jaw piece 40 with the inclined portion 42*a* facing the wedge engaging end 40*a* and the second fixture wall 34. The wedge 42 is adapted to reciprocate vertically (direction AA) such that its inclined portion 42*a* slidably engages with the wedge engaging end 40*a* of the jaw piece. An opposed portion 42*b* of the wedge, disposed opposite the inclined portion 42*a*, slidably engages against the first wall 32. The inclined portion 42*a* and opposed portion 42*b* of the wedge are preferably made of a relatively nonelastic material such as a hardened steel that is finished smooth to minimize friction. If desired, the middle of the wedge, between the inclined and opposed portions, can be made slightly elastic relative to the inclined and opposed portions, 42*a* and 42*b*. The inclined portion 42*a* preferably includes a planar section that is angled at approximately the same inclination angle as the planar inclined surface of the wedge engaging end of the jaw piece 40.

An actuator 46 is operatively coupled to the wedge 42 through an elastic (spring) means 44 to move the wedge and apply a generally continuous first force $F_1$ in the vertical direction AA to the wedge 42. The first force $F_1$ is translated by the inclined portion 42*a* of the wedge into a pair of outwardly directed second forces, $F_2$ and $F_2'$, which are respectively exerted laterally against the jaw piece 40 and the first fixture wall 32. The jaw piece 40 transmits its respective second force $F_2$ to the securable surface 116*c* of the workpiece and therethrough, outwardly against the second of the opposed fixture walls, 34. It will be noted that the second forces, $F_2$ and $F_2'$, are developed compressively through the wedge 42, jaw piece 40, and workpiece 116. These forces, $F_2$ and $F_2'$, should preferably be directed along a straight line.

Figure 1:
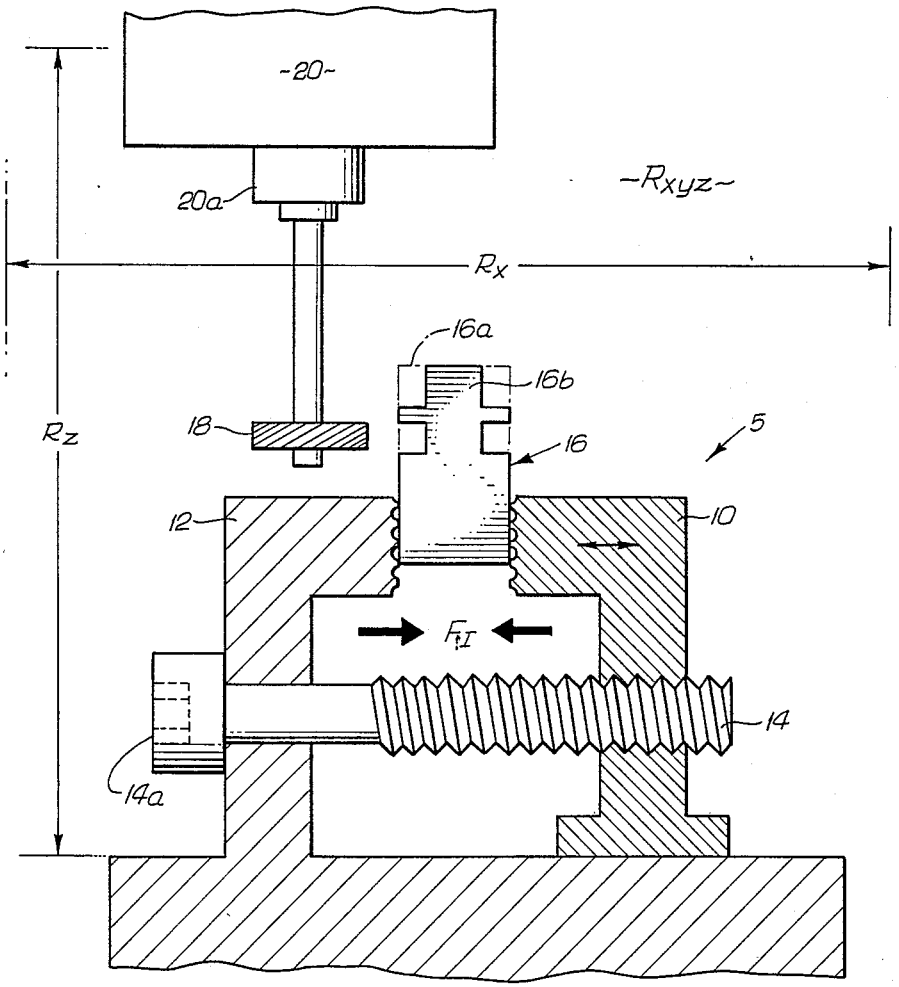
Fig. 1 PRIOR ART
FIG. 1 is a sectional view showing a conventional way for fixedly securing a workpiece in a numerically controlled milling machine.

A leverage advantage may be obtained between the first force $F_1$ and the second forces, $F_2$ and $F_2'$, by suitably angling the inclined portion 42*a* of the wedge (and the complementary inclined wedge engaging end 40*a* of the jaw piece) so that the second forces, $F_2$ and $F_2'$, are substantially greater than the first force $F_1$. An inclination of less than 45° away from the vertical is preferred. An inclination of approximately 26 degrees or less away from the vertical (cotangent $26° > 2$) is more preferred and an inclination less than 11 degrees (cotangent $11° > 5$) is even more preferred. The U-shaped force containing portion 31*a* of the fixture is preferably made sufficiently thick and stiff to contain the laterally directed second forces $F_2$ and $F_2'$ without substantial deformation. Since the first force $F_1$ can be applied to the wedge 42 without drilling a hole through the fixture walls, 32 and 34, the force containing portion 31*a* can be made quite strong in comparison to for example, the fixed jaw of a conventional vise (FIG. 1) which usually does have a hole bored through it.

Figure 3:
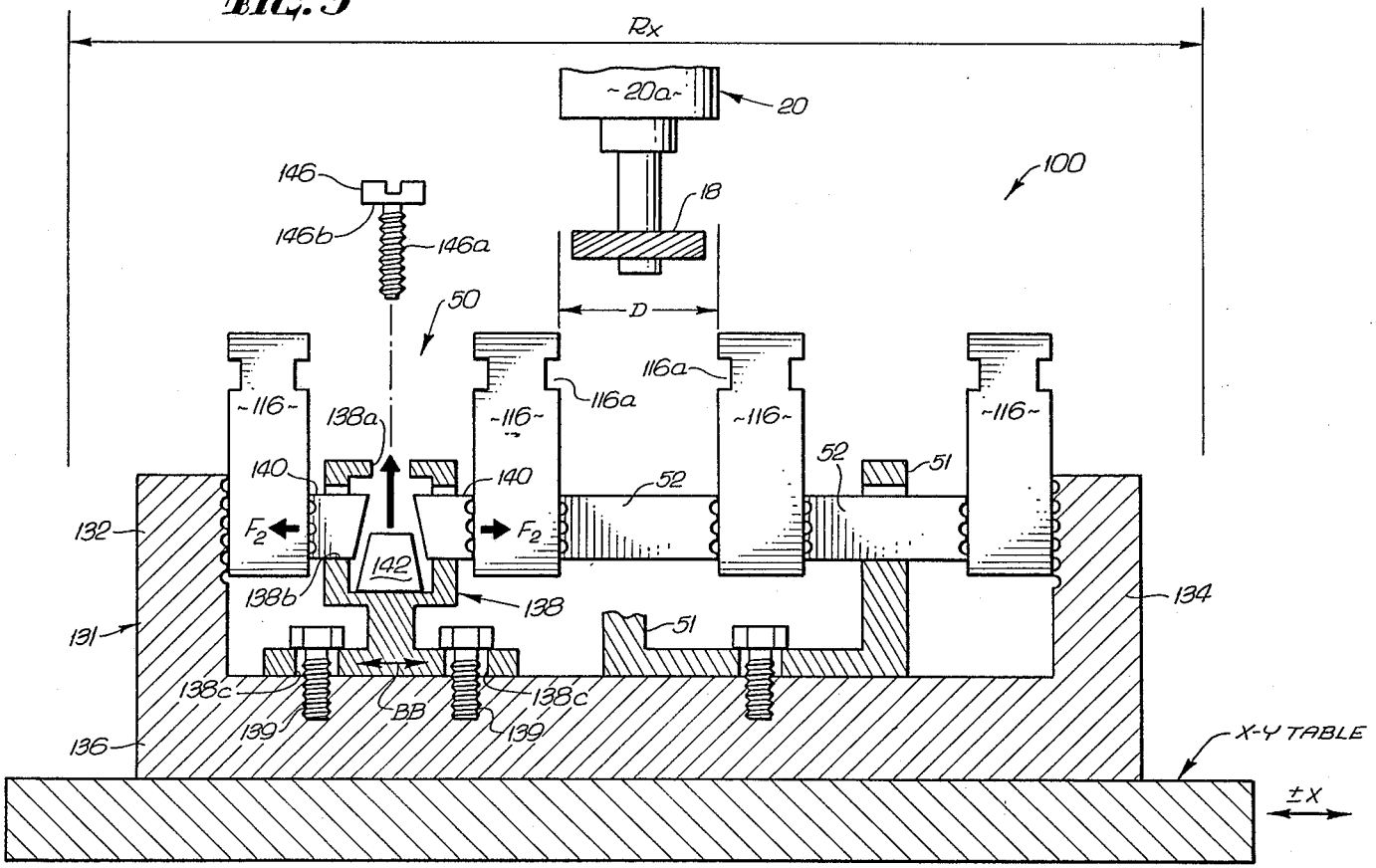
FIG. 3 is a sectional view showing a second clamping device according to the invention.

The wedge 42 and jaw piece 40 can also be made quite compact, even in cases where the second forces $F_2$ and $F_2'$ are relatively large, because the second forces $F_2$ and $F_2'$ are applied in a substantially compressive manner through the materials of the wedge 42 and jaw piece 40. The lateral thickness of the wedge and jaw piece can, generally speaking, be chosen independently of the magnitude of the lateral forces, $F_2$ and $F_2'$. Usually, the lateral forces $F_2$, $F_2'$ have to be strong enough to create indentations in the workpiece surface 116*c* so that the workpiece will not slide out. The amount of lateral space occupied by the wedge and jaw piece can be minimized by minaturizing their lateral dimensions. Although this may not seem important in the configuration shown in FIG. 2, a brief reference to the arrangement illustrated in FIG. 3 will make apparent how the minaturization of the wedge and jaw piece can result in optimal space utilization. In FIG. 3, multiple workpieces 116 are retained within a U-shaped fixture portion 131 between a wedge actuated expansion device 50 and plurality of movable spacers 52. A workpiece separation distance D is preferably reduced between the workpieces 116 to provide for just the minimum room required to access side portions 116*a* of the workpieces with a preselected cutting tool 18. As the separation distance D is reduced, more workpieces can be secured within the limited working area R of the tool spindle 20*a*. The embodiment of FIG. 3 will be explained in more detail later on.

Referring back to FIG. 2 and more specifically to the actuator means 46 and elastic means 44 of FIG. 2, it will be apparent to those skilled in the art that a large variety of specific structures may be used to provide the wedge moving function and elastic force applying function of the actuator means 46 and elastic means 44. The functions can be provided individually by discrete elements or the functions can be integrated into a single element. By way of example only, an eccentric cam rod 46' having an elastic portion 44' is shown dispopsed between the bottom of the wedge 42 and the base 36. The eccentric cam rod 46' may be rotated by a suitable actuating tool to generate the first force $F_1$ vertically against the wedge 42. If desired, the cam rod 46' can be used in conjunction with other types of actuator means 46 and elastic means 44 to selectively generate respective subcomponents of the first force $F_1$ and thereby selectively set the magnitude of the second force $F_2$. The other types of devices can include springs, screws, wedges, and so forth. As will be explained later, the elastic means 44 and actuator means 46 can be formed integrally as a simple machine screw having a slightly elastic characteristic.

If the wedge 42 shifts slightly in the vertical direction AA, the elastic means should preferably deform and continue to apply substantially the same first force $F_1$ against the wedge. The second forces $F_2$ and $F_2'$ will thereby continue to be exerted at substantially the same strength outwardly of the wedge in the lateral direction BB against the workpiece 116. The specific values of the forces $F_1$ and $F_2$, $F_2'$ will of course depend on the elastic properties of the elastic means 44 and the angle of the inclined portion 42*a*. In cases where it is desirable to apply a predetermined constant force against the workpiece 116, a constant force spring may be incorporated into the elastic means.

A self-tightening function can be obtained from the continued force applying action of the elastic means 44. If for example, the cutting tool 18 transmits a loosening vibration to the securable surface 116*c* of the workpiece so as to cause that surface 116*c* to move away from the wedge 42 in the direction CC, as shown in FIG. 2, the jaw piece 40 will tend to follow the surface 116*c* and thereby loosen its wedge engaging end 40*a* away from the inclined portion 42*a* of the wedge. When this happens, the first force $F_1$ that is applied continuously by the elastic means 44 advances the wedge 42 (upwardly in FIG. 2) such that the inclined portion 42*a* tightens back against the wedge engaging end 40*a* of the jaw piece to take up the slack. The more the workpiece shakes, the more the wedge advances to further tighten the jaw piece against the workpiece. The lateral second force $F_2$ consequently continues to be applied against the securable surface 116*c* of the workpiece and the danger of the workpiece being vibrated away from its original position in the fixture 31 is substantially reduced.

Referring now to FIG. 3, another embodiment 100 of the invention will be described. Like reference numbers are used in FIG. 3 to denote elements similar to those of FIG. 2. The embodiment 100 comprises a force containing fixture 131 of a U-shaped cross section having opposed vertical fixture walls 132 and 134 between which there may be secured one or more workpieces, 116. The fixture 131 is preferably elongated in the direction perpendicular to its U-shaped cross section out of the plane of FIG. 3. (See FIG. 4B). A wedge actuated expansion device 50, having a wedge 142 with plural inclined surfaces and a corresponding plurality of movable jaw pieces 140, is disposed laterally between the fixture walls 132, 134 and the workpieces 116 so as to apply a laterally oriented securing force $F_2$ to one or more of the workpieces 116. The wedge 142 and jaw pieces 140 are retained within a movable housing 138. A force applying hole 138*a* is provided at the top of the housing 138 for applying a first force $F_1$ vertically to the wedge 142. A plurality of force projecting holes 138*b* are provided at the sides of the housing 138 to guide the jaw pieces 140 laterally out of the housing 138. The housing 138 is slidably fastened at its bottom to a base portion 136 of the U-shaped fixture 131 by means of a pair of retaining bolts 139 projecting through a corresponding pair of oversized retaining holes (or slots) 138*c* defined in the housing. The oversized holes 138*c* allow the housing 138 to shift laterally in the direction BB as indicated in FIG. 3.

A spacer holding member 51 reciprocally retains one or more movable spacers 52 between the workpieces 116. Small variations in thickness may occur among the workpieces 116. Chips of cut material and other loose debris can sometimes become trapped between the sides of the workpieces 116 and the fixture walls and/or spacers. The movable jaw pieces 140 and movable spacers 52 should be able to 'float' laterally within the fixture 131 in order to compensate for such thickness variations and trapped debris. If the wedge 142 is to remain centered with a straight line along which the first force $F_1$ is preferably applied through the force applying hole 138*a* of the housing, it is furthermore preferred that a certain amount of float be provided between the wedge 142 and the housing 138. In the illustrated embodiment 100, this float is provided by oversizing the top hole 138*a* relative to a force applying means 146 (shown exploded away from the wedge 142). By way of example, the force applying means 146 is shown to be a flat head machine screw which is made of a metal that is relatively elastic in comparison to the material of the wedge 142. A shank portion 146*a* of the force applying screw is threaded into the wedge 142 while a flattened base portion 146*b* engages slidably with a flattened top portion 138*d* of the housing 138 to provide lateral play. With this arrangement, the wedge and jaw pieces can float laterally relative to the housing while the first force F, is applied.

The expansion device 50 and spacers 52 are preferably dimensioned to separate the workpieces 116 by a preselected separation distance D that is reduced to allow just enough clearance for accessing side portions 116*a* of the workpieces with a required tool 18. By minimizing the space requirements of the expansion device 50 and the spacers 52, it becomes possible to maximize the number of workpieces 116 that can be fixedly secured within the working area R of the CNC machine 20. In FIG. 3, it is assumed that the cutting tool 18 can rotate in its spindle 20*a* to face opposed side portions 116*a* of corresponding workpieces that are separated by the distance, D. As such, the distance D needs to be only slightly longer than the dimensions of the tool 18 to provide room for inserting the tool between adjacent workpieces.

Preferably, the workpieces 116 are formed as elongated strips of stock material (extending perpendicularly to the plane of FIG. 3) so that a plurality of individual machined items can be produced from each of a plurality of elongated strips. The fixture 131 is similarly elongated. In such a case, a plurality of expansion devices 50 and corresponding set of spacers 52 may be provided in the elongated direction with each row of expansion devices and corresponding spacers being spaced apart along the length of the workpiece strips so as to fixedly secure the strips along the entire elongated length of the U-shaped fixture 131 (see FIG. 4B). Variations in stock thickness are compensated for by the floating action (play) of each row of expansion devices and spacers.

The embodiment 100 of FIG. 3 can reduce manufacturing cost in at least two ways. The time required for securing and releasing a plurality of workpieces may be reduced in comparison to the conventional vise (FIG. 1) because a single actuation of the wedge 142 secures or releases in unison the multiple securing points of a plurality of workpieces 116. Minaturization of the expansion device 50 can be employed to increase the number of workpiece strips which may be secured at one time within the working region R of the CNC machine. A machinist can consequently spend less time setting up more workpieces in the CNC machine fixture using this multiple strip arrangement and the cost per item can be reduced accordingly.

Figure 4A:
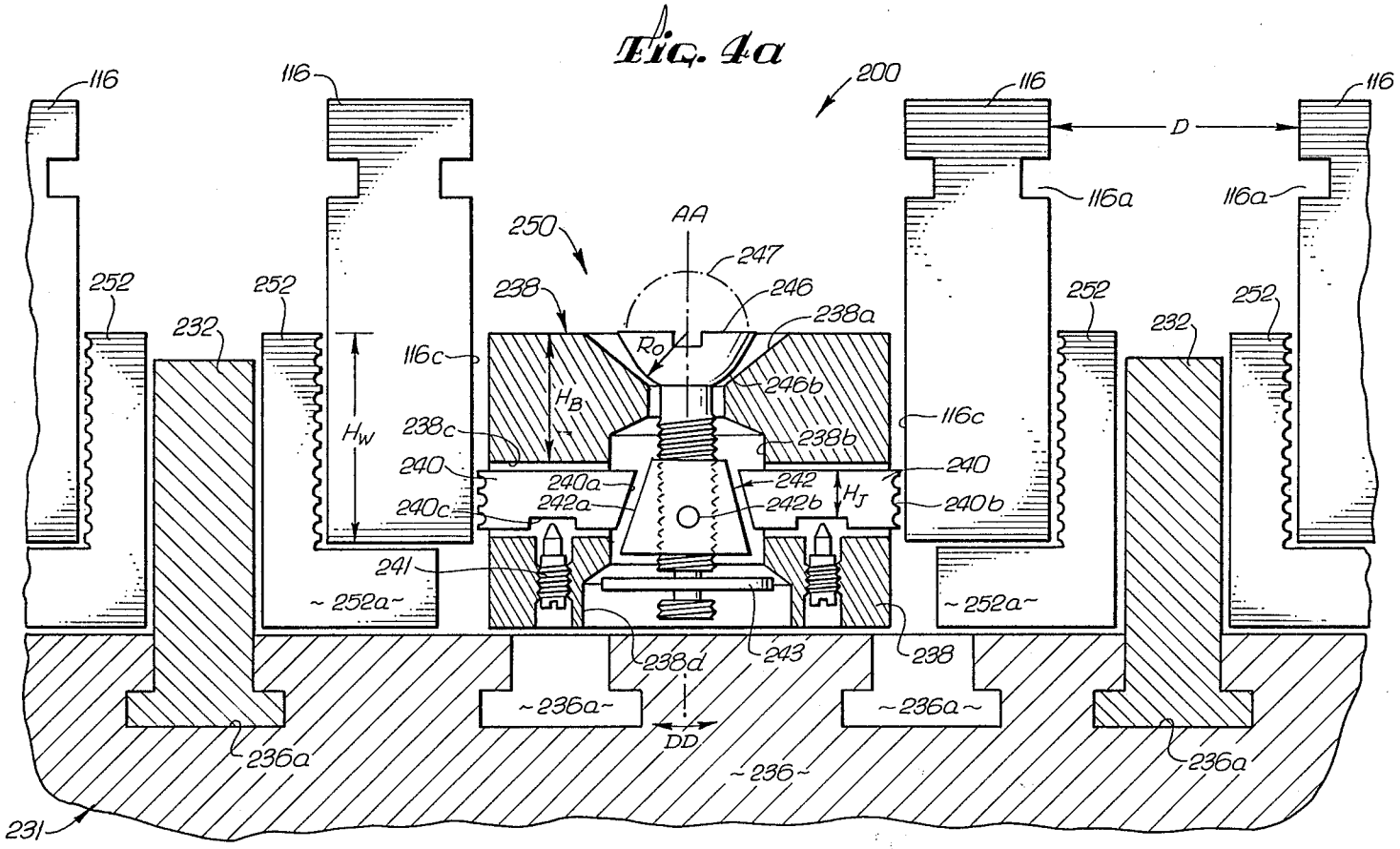
FIG. 4A is a sectional view showing a third clamping device according to the invention.

FIG. 4A is a sectional side view of a third embodiment 200 according to the invention. A rectangularly shaped expansion device 250 is slidably mounted to a slotted base portion 236 of a machine fixture 231. The base portion 236 has a plurality of standardized slots 236*a* (preferably inverted-T slots) which are adapted to receive a matching set of vertical wall members 232. A plurality of L-shaped spacers 252, designed to conform to the dimensions of a pre-selected set of workpiece strips 116, ar braced in mirror-like fashion against the wall members 232. Ledge portions 252*a* of the spacers 252 can be used to supportively locate the workpiece stock 116 by a predetermined distance above the base portion 236. The expansion device 250, spacers 252, and wall members 232 are preferably selected to separate the workpiece stock 116 by a minimum separation distance D required for machining side portions 116*a* of the stock.

Figure 4B:
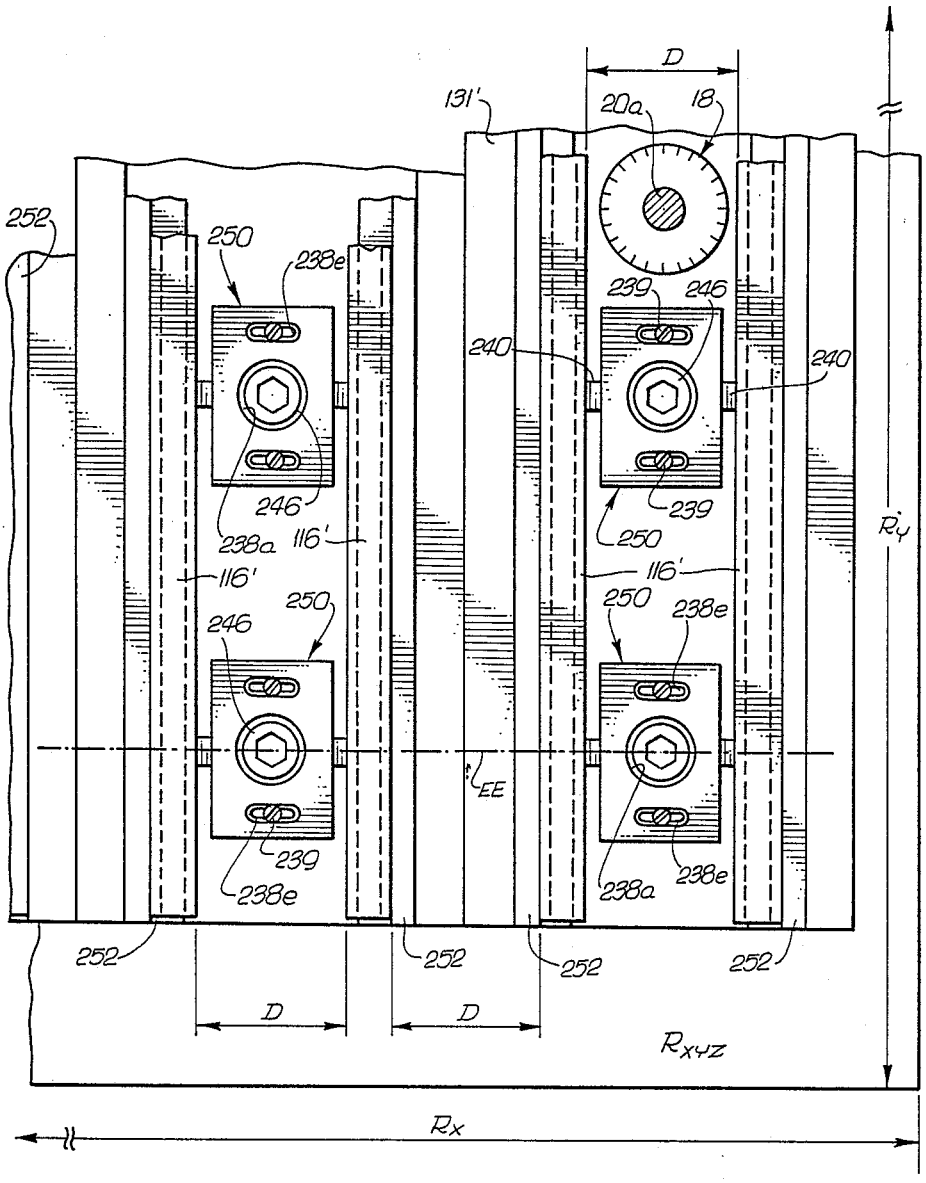
FIG. 4B is a top view of a workbed in accordance with the invention.

Each pair of opposed wall members 232 together with the portion of the base 236 extending between them can be viewed as a modular force containing unit for containing the outwardly directed lateral forces $F_2$, $F_2'$ developed by the expansion device 250. Multiple expansion devices can be positioned within each modular force containing unit and multiple force containing units can be formed on the machine fixture as allowed by the dimensions of the workpieces 116 and the working region R of a particular CNC machine 20. If desired, the force containing modular units can be formed instead as elongated integral units of a U-shaped cross section (i.e. like the fixture 131 of FIG. 3) rather than being formed by the separate wall members and single base shown in FIG. 4A and such integral U-shaped units (131) can be stacked one next to the other on the workbed (movable x-y table) of the CNC machine 20 to thereby form a plurality of parallel force containing channels (e.g. of a stacked UUU . . . U configuration). A top view of a CNC workbed having such an arrangement is shown in FIG. 4B. That figure will be explained later on.

The expansion device 250 is preferably constructed of a rectangularly shaped block or housing 238 that has planar top, bottom and side faces. The housing 238 is bored to guide a plurality of movable jaw pieces 240 reciprocally in a lateral direction and a movable wedge 242 reciprocally in a vertical direction. A certain amount of tolerance or 'play' is provided in the boring of the housing 238 so that the wedge 242 and jaw pieces 240 can pivot slightly (as indicated at DD) to accomodate minute differences that may occur between side surfaces 116*c* of opposed workpiece stock 116. The pivoting action is shown in exaggerated form in FIG. 5 and will be explained in more detail later. The planar bottom face of the housing allows the housing 238 to slide laterally along the fixture base 236. Slotted holes 238*e* (FIG. 4B) are formed through the housing 238 in front of and behind the illustrated cross section to movably fasten the housing to the fixture base 236.

It should be explained at the outset that the relative dimensions of the parts shown in FIG. 4A are exaggerated for the purpose of illustration. The lower height portion $H_w$ of each of the workpieces 116 which is captured between the upper height of the housing 238 and the upper heights of the spacers 252 and/or vertical wall members 232 constitutes a non-workable (non-accessible) portion of the stock material 116 that is usually discarded after the to-be-machined individual items (116*b*) are completed. The items (116*b*) are usually machined only out of the protruding top portion of the stock 116. In order to minimize waste, it is desirable to minimize the height $H_w$ of the non-workable lower portion of the stock 116. The jaw pieces 240 should be of a certain predetermined vertical thickness $H_j$ so they can withstand non-horizontally directed subcomponents (e.g. minute torsional subcomponents arising from small angular differences) of the large lateral forces ($F_2$, $F_2'$) exerted against the jaw pieces by the wedge 242 and workpiece surface 116c. The upper height $H_B$ portion of the housing 238, above the jaw pieces 240, usually does not have to withstand large forces and can therefore be made relatively thin in the vertical direction. Preferably the upper height portion $H_B$ of the housing block should be reduced in its vertical thickness so as to provide just enough strength for withstanding the vertical forces $F_1$ applied to pull up the wedge 242. Two advantages result therefrom. The housing 238 can be made to have an extremely low profile (minaturized height) so that less stock material $H_w$ is wasted, and the griping forces $F_2$, $F_2'$ of the jaw pieces are moved closer to the working areas 116a of the workpieces for improved leverage during cutting operations.

A force applying screw 246 is threaded through the wedge 242. The pitch of the threads on the screw 246 is preferably chosen to provide a leverage advantage for converting a torsional tightening force applied at the head of the screw into a vertically directed force developed at the shank portion of the screw. The shank portion of the screw 246 is preferably made of a material that is elastic or spring-like in comparison to preferably stiffer inclined portions 242a of the wedge 242 and/or wedge engaging end 240a of the jawpieces. The elastic or spring-like characteristics of the screw 246 may be obtained by using a heat treated steel such as employed in Holo-Krome Company No. 1/4-28 61024 machine screws. (These particular screws are threaded at a 3° pitch so they provide a torsion to vertical force advantage of roughly 1:19.) The force applying screw 246 has a frusto-conically shaped head portion in which a base segment 246b is ground to the shape of a spherical segment belonging to a phantom sphere 247 having a radius $R_O$. This spherically ground base segment 246b rests in a first counter-sunk circular bore 238a provided through a top side of the housing 238. The first bore 238 is dimensioned such that the screw 246 can pivot about a vertical axis AA passing centrally through the first bore 238a. In an alternate embodiment (see FIG. 6A) the first bore 238a is ball cut to more fully mate with the spherically ground base 246b. In the latter case, the entire base portion of the screw head can be spherically shaped to distribute force from the head of the screw to the bore 238a in a more uniformly dispersed manner. Regardless of whether the first bore 238 is counter-sunk in a conical fashion or ball cut in a spherical fashion, the pivoting action of the spherically shaped screw base 246b allows the force of the screw 246 to be uniformly distributed around the circumference of the bore 238a, even if the screw force is not parallel to the bore axis AA.

A second bore 238b is formed through the bottom face of the housing 238 along the same vertical axis AA to allow the wedge 242 to move up freely within the housing 238. Although not shown, a vertical keying slot is provided in a wall portion of the second bore 238b and adapted to receive a complementary keying pin 242b projecting from the wedge 242. The keying slot (not shown) and keying pin 242b mate loosely to provide the wedge with a predetermined amount of play but to prevent the wedge 242 from twisting by a substantial amount when the screw 246 is turned.

The wedge 242 itself, is preferably made of a cylindrical stock which has a threaded hole passing through its center and a plurality of inclined faces 242a milled to a smooth finish on its exterior. The inclined faces 242a mate with complementary wedge engaging ends 240a of the movable jaw pieces 240. The inclined faces 242a and wedge engaging ends 240a are prefereably planar and inclined at substantially the same angle so that their surfaces mate with maximum contact during the entire vertical travel of the wedge 242. Uniform force distribution is thereby obtained.

The jaw pieces 240 are also generally of a cylindrical shape and fitted through lateral bores 238c. Serrations are provided on workpiece engaging ends 240b of the jaw pieces. Retaining flats 240c are milled along the sides of the jaw pieces so that a retaining pin or screw 241 can be positioned into the jaw piece flat 240c to prevent the jaw piece 240 from sliding completely out of the housing 238. A spring clip 243 is clipped onto a bottom portion of the screw 246 to keep the screw 246 in the housing 238. The spring clip 243 is dimensioned to sit in a fourth bore 238d provided at the bottom of the housing 238. The spring clip 243 helps to pull the wedge 242 downwardly when the screw 246 is turned to release the stock 116. A flat washer (not shown) can be used in combination with the spring clip for added strength. Some clearance is provided between the clip 243 and bore 238d to create play between the wedge 242 and the housing 238.

Clearances are shown between individual pieces in FIG. 4A to facilitate the identification of each piece. It will be appreciated that when the screw 246 is tightened, the wedge 242 moves upwardly to force the jaw pieces 240 outwardly against the stock 116. The stock 116 is then pushed tightly against the spacers 252 and vertical wall members 232. Clearances shown in the third and fourth bores, 238c and 238d, are preferably retained so the wedge screw 246, the wedge and jaw pieces can pivot slightly. As mentioned previously, the housing 238 is allowed to move laterally.

Figure 5:
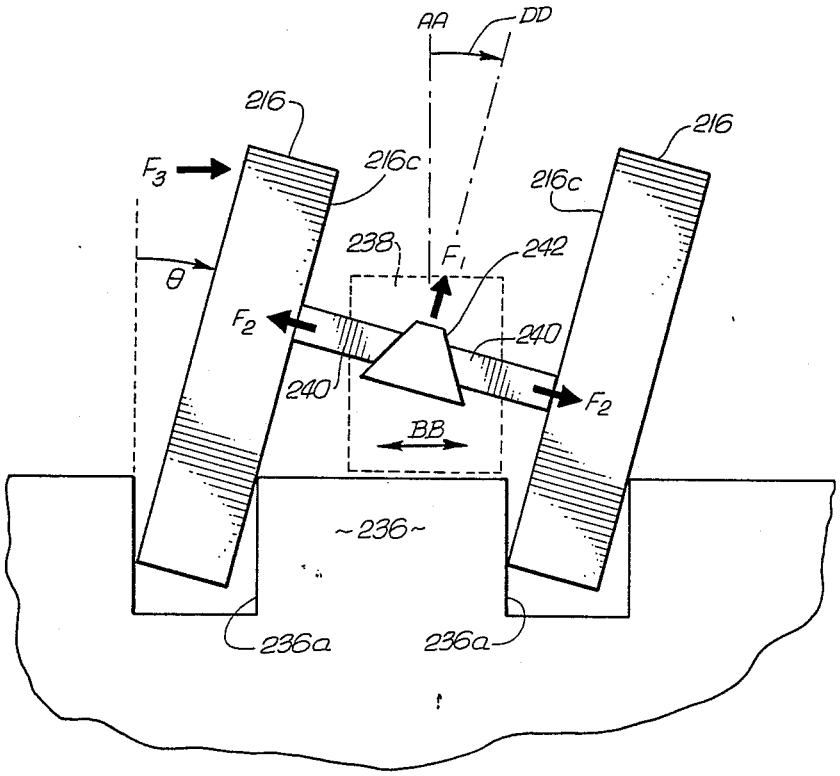
FIG. 5 shows how a clamping device of the present invention can float to center itself between a pair of vertical members that are not perpendicular to a fixture base.

FIG. 5 is a simplified diagram showing in exaggerated form how the lateral movement of the housing 238 and the pivoting action of the wedge and jaw piece subassembly can compensate for an angular difference between the expansion device housing 238 and the side surfaces 216c of a vertical member 216 projecting from the base portion 236. It will of course, be understood that the vertical member 216 represents one or a combination of the workpiece 116, spacer 252 and vertical member 232 shown in FIG. 4. If the sides 216c of the vertical pieces 216 are not parallel to the sides of the housing 238 because, for example, an external force $F_3$ tilts the vertical pieces (or because loose debris is trapped between one or more of the vertical sides); the housing 238 can reciprocate in the lateral direction BB while the wedge and jaw piece subassembly 242/240 pivots away from the perpendicular AA to center the subassembly at an angle DD between the vertical pieces 216. As such, the securing forces $F_2$ can be applied compressively and equally against the vertical pieces 216 to secure the vertical pieces in the base portion 236. The three dimensional play (pivoting and lateral reciprocation) of the wedge/jaw piece subassembly 242/240 can compensate for various misalignments and dimensional fluctuations in the overall workpiece securing system while directing the lateral forces $F_2$, outwardly of the wedge 242.

FIG. 4B is a top view of a CNC workbed that is set up to allow for the single cycle machining of plural parallel strips 116' of workpiece stock. The strips 116' are preferably elongated to substantially fill the total lengthwise dimension $R_y$ of the limited working region R of the CNC machine 20 (not shown). The strips 116' are furthermore preferably spaced apart from one another by a minimum separation distance D that is required for accessing side portions of the stock material with a predetermined tool 18. This arrangement allows one to maximize the utilization of the widthwise dimension $R_x$ of the working region R by filling the widthwise direction $R_x$ with as many workpiece strips 116' as possible. In this manner, the $R_x$ by $R_y$ area of the working region R can be filled to its maximum capacity with workpiece material (116') and optimum utilization of the CNC machine's reach can be obtained during the single cycle machining of each batch of workpiece stock (e.g. each set of parallel strips 116').

In FIG. 4B, a plurality of modular fixture units 131', that are elongated to substantially fill the lengthwise $R_y$ dimension of the workbed and formed with U-shaped cross-sections in the widthwise direction ($R_x$), are stacked against each other to create a series of parallel vertical walls between which there are disposed in matrix-like fashion, a plurality of expansion devices 250, such as the one shown in FIG. 4A. Machine screws 239 are used to fasten the expansion devices 250 through housing slots **238*e* to the bottom base portions of each of their respective fixture units 131' such that the housings 238 can shift at least slightly in the widthwise direction. Preferably, the jaw pieces 240 of each widthwise row of expansion devices are positioned along straight lines EE so that their respective outwardly directed expansion forces, $F_2$ and $F_2'$, will act compressively against opposed sides of each of the vertical walls of the modular fixture units 131'**.

With respect to the shape of the modular fixture units 131', it should be understood that a variety of different modular structures could be employed to create either a series or matrix of vertical wall members between which a plurality of workpiece stock and a plurality of expansion devices may be inserted. By way of example only, the fixture units 131' could be modified to have L-shaped cross-sections that interlock with each other in configurations such as LLLL . . . L or inverted T-shaped cross sections that can be connected to one another in a configuration such as an inverted TTTT···T to create a series or matrix of vertical wall members. The modular fixture units could be added by stacking and/or interlocking to thereby provide as many as are needed for optimizing a particular machining job.

It should be understood that the workpiece stock need not be arranged in parallel strip fashion as shown but could instead be arranged as individual pieces spaced apart from each other to be secured in a honeycomb fashion. In the latter case, a corresponding set of vertical wall members and expansion devices would be arranged in honey-comb fashion to create a matrix of securing spaces for the workpieces. By way of example, each fixture could be an open-top rectangular box and each corresponding expansion device could have a wedge of a rectangular-pyramid shape driving four jaw pieces outwardly at right angles to one another.

With respect to the time it takes to operate the wedge operated expansion devices (e.g. 250) so that the workpieces are secured, it should be appreciated that the speed at which the movable jaw pieces can be made to move outwardly from the center of the wedge is dependent on the angle of inclination of the wedge and the pitch of the force applying screw. In some instances, it may be desirable to extend the jaw pieces outwardly of the expansion device rapidly at first (to save production time) and then, as the jaw pieces engage against the workpiece, more slowly to gain greater leverage advantage.

Figure 6A:
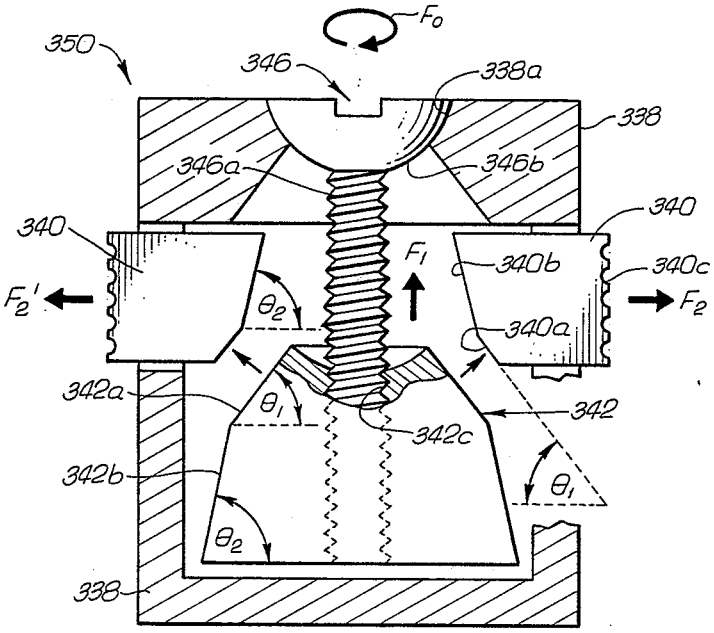
FIGS. 6A and 6B show two possible configurations for clamping devices having inclines of different angles.

FIG. 6A is a sectional view of an expansion device 350 in which a wedge 342 is provided with a first inclination **342*a* rising at a relatively shallow first angle $\theta_1$, and a second inclination 342*b* rising at a steeper second angle $\theta_2$. The second inclination 342*b* is positioned to engage a similarly inclined jaw surface 340*b* of a corresponding jaw piece 340 after the first inclination 342*a* slides beyond a correspondingly inclined first jaw surface 340*a*. The inclinations, 342*a* and 342*b*, and the inclined jaw surfaces 340*a* and 340*b* are preferably all planar so that each mates as fully as possible with its counterpart when the wedge 342** is driven vertically. While not shown, curved sections may, of course, be used to link one planar inclined section to the next.

A pivotal force applying screw 346 is threaded into a matching hole **342*c* defined vertically through the wedge 342. The screw 346 has a shank portion 346*a* which is threaded at a predetermined pitch to transform a rotational force $F_0$ applied to the head of the screw into a vertical wedge advancing force $F_1$ as desired. Preferably the pitch of the screw 346 should be less than 45° so that a leverage advantage is obtained. The vertical motion of the wedge is transformed into a lateral motion of the jaw pieces 340. Preferably, the first and second angles, $\theta_1$ and $\theta_2$, should be chosen to provide a further leverage advantage for applying outwardly directed expansion forces ($F_2$, $F_2'$) through serrated end portions 340*c***of the jaw pieces.

The head of the force applying screw has a spherically shaped base **346*b* that mates pivotally into a ball cut opening 338*a* of approximately the same radius at the top of a housing block 338. Clearances are provided in the housing block 338 so that the screw 346, wedge 342** and jaw pieces can pivot therein while applying outwardly directed forces $F_2$ to one or more workpieces (not shown).

As will be apparent by application of the wedge principle to the embodiment of FIG. 6A, if a rotational force $F_0$ is applied at a fixed speed to the head of the screw 346, the jaw pieces 340 would move at two different speeds and apply inversely related lateral forces $F_2$ as the first and second inclinations, **342*a* and 342*b*, press against the corresponding jaw piece surfaces, 340*a* and 340*b***. That is, the input/output force and speed ratios would change as the inclination angles change.

Figure 6B:
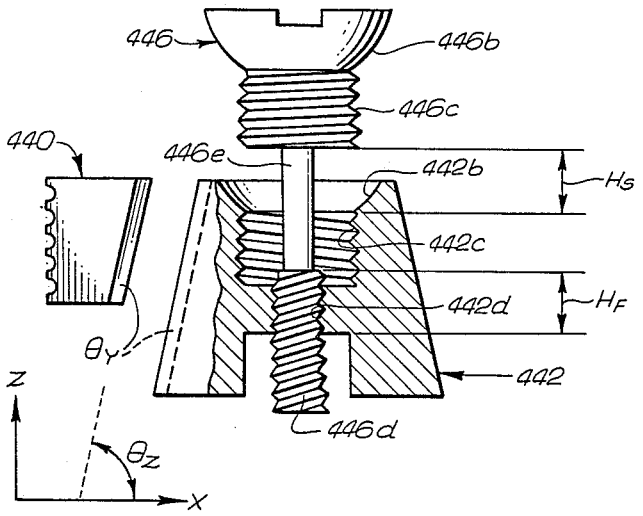

FIG. 6B illustrates another method for obtaining different jaw piece speeds and input force/output force ratios (i.e. $F_o/F_2$) for an expansion device. For simplicity, like reference numerals are used to denote like elements and only one jaw piece 440, a wedge 442 (shown in partial cross section), and a corresponding force applying screw 446 are shown. The screw has a spherically shaped base **446*b* at the bottom of its head. Below the head is a thick first threaded section 446*c* whose threads are pitched for applying a relatively large vertical force ($F_1$) to a correspondingly threaded first bore 442*c* in the wedge with a relatively large leverage advantage (slow speed). Above the first bore 442*c* is a ball cut opening 442*b* in the wedge that is shaped to receive the spherical base portion 446*b* of the screw head. A thin second threaded section 446*d* is provided on the screw 446 below the first threaded section 446*c*. The second threaded section 446*d* is threaded with a larger pitch angle than that of the first threaded section 446*c* so that it provides a relatively smaller leverage advantage but does so at the gain of increased jaw piece speed. The wedge 442 has a correspondingly threaded second bore 442*d* into which the second threaded section 446*d* mates. An unthreaded section 446*e* of the screw, which is thinner than the second threaded section 446*d*, separates the latter from the first threaded section 446*c*. The unthreaded section 446*d*** is preferably of a spring-like nature.

The screw 446 and wedge 442 are dimensional so that a slow take-up distance $H_s$ between the bottom of the first threaded section **446*c* and the top of the first bore 442*c* is approximately equal to or slightly smaller than a fast take-up distance $H_F$ between the bottom of the second bore 442*d* and the top of the second threaded section 446*d*. With this arrangement the slower acting, more forceful first threaded section 446*c* grabs hold of the threads in the first bore 442*c* just as the faster acting, less forceful second threaded section 446*d* is releasing itself of the threads in the second bore 442*d*. The intermediate unthreaded section 446*e* is preferably provided with some resiliency (elasticity) to compensate for the case of an overlap between the time the stronger and slower, first threaded section 446*c* catches and when the weaker and faster, second threaded section 446*d*** releases.

Another method for providing multiple input/output speed and force ratios is to angle the inclined surfaces of the wedge and jaw pieces at a first angle $\theta_z$ in the Z direction (vertical direction) and to also angle the surfaces at a second angle $\theta_y$ in the Y direction (e.g. out of the plane of FIG. 6B) as indicated in the left half of FIG. 6B. In this case, the wedge 442 may be shaped as a segment of a triangular pyramid (frusto-pyramidal shape). The wedge is moved in the Z direction to obtain a first set of input/output speed and force ratios and in the Y direction to obtain a second set of input/output speed and force ratios. Although not shown, the movement of the wedge 442 in the Y direction may be obtained by slidably disposing a second wedge in the Y direction between the shown wedge 442 and a side portion of the expansion device housing (not shown). Many other methods for forcibly displacing the wedge 442 in the Y direction will be apparent to those skilled in the art.

Numerous variations to the instant invention will occur to those skilled in the art, some of the variations being mere matters of routine design choice, and others being derived from a detailed study of the present disclosure. For example, the vertical wall members 232 of FIG. 4 can be arranged to surround the housing 238 on four sides and additional jaw pieces can be provided to project outwardly from the housing 238 so that a plurality of more than two work pieces can be secured by the actuation of a single expansion device. Moreover, it will become apparent that the expansion device can have a top view geometry that is triangular, hexagonal, or any other geometric shape; and that a plurality of movable jaw pieces can extend from such an expansion device at multiple angles to secure a plurality of work pieces against a plurality of suitably disposed vertical wall members. The list of possibilities can continue indefinitely. As such, the scope of the present invention should not be limited to the embodiments described above, but should rather be defined by the appended claims and equivalents thereof.

I claim:

1. A clamping device comprising:

a fixture having a force containing portion of a generally U-shaped cross section, wherein opposed vertically directed segments of the U-shaped force containing portion define first and second fixture walls;

a first movable jaw piece, mounted to a fixture between the first and second fixture walls so as to reciprocate laterally toward and away from the fixture walls and having an inclined portion facing one of the walls;

a movable wedge, disposed between the first jaw piece and the first fixture wall, the wedge being adapted to reciprocate vertically and being shaped to include a first inclined portion which faces one of the walls and is engagable with the inclined portion of the first jaw piece to thereby drive the first jaw piece in the lateral direction; and actuator means, coupled to the wedge, for driving the wedge in the vertical direction.

2. A clamping device according to claim 1 further comprising an elastic means, interposed between the actuator means and the wedge, for elastically applying a first force in the vertical direction to the wedge.

3. A clamping device according to claim 2 wherein the elastic means includes a screw having a first threaded section of a predetermined pitch.

4. A clamping device according to claim 3 wherein a first threaded bore is defined in the movable wedge matching the first threaded section of the screw.

5. A clamping device according to claim 4 wherein the screw and wedge respectively include a second threaded section and matching second threaded bore of a pitch different from the pitch of the first threaded section and first threaded bore.

6. A clamping device according to claim 3 wherein the screw has a head portion with a spherically shaped base.

7. A clamping device according to claim 3 wherein the screw is made of a material more elastic than the material of the first inclined portion of the wedge.

8. A clamping device according to claim 1 wherein the first inclined portion includes first and second planar surfaces that are inclined at different angles.

9. A clamping device according to claim 1 wherein the wedge has a triangular-pyramidal shape.

10. A clamping device according to claim 1 further comprising float means for allowing the wedge to shift laterally relative to the fixture.

11. A clamping device according to claim 1 further comprising a second movable jaw piece, mounted to the fixture to reciprocate laterally between the first and second walls, wherein the wedge is interposed between the first and second jaw pieces and the wedge includes a second inclined portion which is engagable with the second jaw piece to thereby drive the second jaw piece in the lateral direction.

12. A clamping device for clamping one or more workpieces comprising:

a force containing fixture having opposed vertical walls spaced apart from one another to provide free space into which the one or more workpieces can be inserted; and an expansion means, disposed between the vertical walls, for expandingly reducing the free space between the walls and applying laterally directed forces outwardly against the one or more workpieces inserted between one of the walls and the expansion means;

wherein the expansion means includes an expansion wedge disposed to reciprocate in a first direction generally parallel to the opposed vertical walls and a jaw piece having an engaging end that is engagable with the wedge, the jaw piece being disposed to reciprocate in a second direction, generally perpendicular to at least one of the vertical walls, thereby reducing the free space between the vertical walls.

13. A clamping device according to claim 12 wherein the expansion means is free to shift laterally between the vertical walls.

14. A clamping device according to claim 12 wherein the expansion means includes first and second jaw pieces, disposed to reciprocate laterally towards and away from the vertical walls along a straight line and a wedge, interposed between the first and second jaw pieces and disposed to reciprocate in a direction generally parallel to the vertical walls.

15. An expansion device for developing an outwardly directed set of expansion forces, comprising:

a housing having top, bottom and side faces, at least one of the side faces being substantially planar;

a movable wedge disposed to reciprocate vertically in the housing, the wedge including a vertical face having an inclined portion;

a first movable jaw piece disposed to reciprocate laterally within the housing, the movable jaw piece including a wedge engaging end having an inclined portion that is adapted to slidably engage with the inclined portion of the wedge; and force applying means, coupled to the wedge, for applying a substantially vertical force to the wedge and reciprocating the jaw piece laterally.

16. An expansion device according to claim 15 wherein the force applying means includes an elastic means for elastically applying the vertical force to the wedge.

17. An expansion device according to claim 15 wherein the housing includes a fastening means for attaching the housing to a substantially planar fixture base such that the housing can move in a direction substantially parallel to the fixture base.

18. An expansion device according to claim 15 wherein the force applying means is coupled to the housing and adapted to allow the wedge to move relative to the housing.

19. A method for securing one or more workpieces comprising:

providing an expansion device having at least one laterally reciprocating jaw piece with a workpiece end that may be extended outwardly away from the expansion device;

providing a workpiece holding fixture having opposed vertical walls between which the expansion device and the one or more workpieces may be fitted;

arranging the one or more workpieces and the expansion device laterally between the walls in a line that is generally perpendicular to the walls; and actuating the expansion device to apply opposed forces outwardly of the expansion device so that the opposed forces are directed against the one or more workpieces and the walls.

* * * * *